US005842882A

United States Patent [19]

Sato et al.

[11] Patent Number: 5,842,882

[45] Date of Patent: Dec. 1, 1998

[54] LAMP SOCKET

[75] Inventors: Kensaku Sato; Tetsuya Takahashi, both of Tokyo; Kouichi Shirouzu, Aichi-ken, all of Japan

[73] Assignee: Hirose Electric Co., Ltd., Tokyo, Japan

[21] Appl. No.: 899,479

[22] Filed: Jul. 24, 1997

[30] Foreign Application Priority Data

Aug. 12, 1996 [JP] Japan ..... 8-227345

[51] Int. Cl.[6] ..... H01R 4/50

[52] U.S. Cl. ..... 439/336; 439/230

[58] Field of Search ..... 439/336, 230, 439/272, 277, 280

[56] References Cited

U.S. PATENT DOCUMENTS

| | | | |
|---|---|---|---|
| 816,483 | 3/1906 | Leonard et al. | 439/277 |
| 2,732,530 | 1/1956 | Dahlhaus et al. | 439/230 |
| 5,743,757 | 4/1998 | Chen | 439/277 |

FOREIGN PATENT DOCUMENTS

| | | |
|---|---|---|
| 0 526 335 A | 2/1993 | European Pat. Off. . |
| 0 650 231 A | 2/1993 | European Pat. Off. . |
| 0 709 936 A | 5/1996 | European Pat. Off. . |
| 0 818 856 A | 1/1998 | European Pat. Off. . |
| 2 302 607 A | 9/1976 | France . |

*Primary Examiner*—Neil Abrams
*Assistant Examiner*—Yong Ki Kim
*Attorney, Agent, or Firm*—Kanesaka & Takeuchi

[57] ABSTRACT

The stopper 70 is provided a seal press 71 for pressing the head portion 66 of an insulation seal member 60. The insulation seal member 60 is attached to the insulation seal mounting portion 7 such that the inner surface of the seal body 61 and the abutment face 67 of the head portion 66 are abutted against the outer surface and the end face of a tubular member 6, respectively, to press the head portion 66 of the insulation seal member 69 with the seal press 71 of the stopper 70 and hold the head portion 66 between the end face of the tubular member 6 and the seal press 71 of the stopper 70.

7 Claims, 14 Drawing Sheets

LAMP SOCKET

BACKGROUND OF THE INVENTION

1. Field of the Invention

The present invention relates to lamp sockets for receiving lamps such as automobile headlights.

2. Description of the Related Art

Some lamps, such as automobile headlights, are as bright as daylight. Such lamps receive an instant high voltage, such as 30 KV and, as FIG. 15 shows, a resilient insulation seal member 93 is attached to a tubular member 96 of a plugging section 92 of a lamp socket 90. An inner cone surface of a plugging section 97 of a lamp plug 95 is pressed against an outer cone surface of the insulation seal member 93 so that the insulation seal member 93 is compressed and integrated with the plugging section, leaving neither space nor creepage surface. Consequently, high insulation and voltage-withstand properties between the central terminal 94 of the plugging section 92 and the outer terminal 91 of the lamp plug 95 are obtained.

However, when the lamp plug 95 is pulled out of the plugging section 92, the insulation seal member 93 comes off from the tubular member 96 of the plugging section 92 along with the plugging section 97 of the lamp plug 95. Consequently, when a new lamp plug 95 is attached, a space and/or a creepage surface are produced between the central and outer terminals 94 and 91, reducing the insulation and breakdown voltage.

In addition, where an attempt is made to minimize the gap between the inner cone surface of the plugging section 97 and the outer cone surface of the tubular member 96, the resilient insulation seal member 93 can be broken, reducing the insulation and breakdown voltage.

Where there is a relatively large gap between the inner cone surface of the plugging section 97 and the outer cone surface of the tubular member 96, the insulation seal member 96 is not compressed satisfactorily so that a space and creepage surface are produced, reducing the breakdown voltage.

SUMMARY OF THE INVENTION

Accordingly, it is an object of the invention to provide a lamp socket with its insulation seal member not coming off when the lamp plug is removed from the lamp socket, thus keeping the insulation and breakdown voltage for a new replacement lamp.

According to one aspect of the invention there is provided a lamp socket which includes a socket body with a plugging section, a central mount at the center of the plugging section, a central terminal in the central mount, an outer mount at the periphery of the plugging section, an outer terminal in the outer mount, an insulation seal mounting portion around the central mount, an insulation seal member attached to the insulation seal mounting portion, and a stopper provided in the central mount to secure the insulation seal member to the insulation seal mounting portion.

The insulation seal member is secured to the insulation seal mounting portion by the stopper. When the lamp plug is pulled out of the lamp socket, the insulation seal member is not removed from the plugging section together with the lamp plug, thus keep the insulation for a new replacement lamp.

According to another aspect of the invention, the lamp socket includes a socket body with a plugging section, a central mount at the center of the plugging section, a central terminal in the central mount, an outer mount at the periphery of the plugging section, an outer terminal in the outer mount, an insulation seal mounting portion around the central mount, an insulation seal member attached to the insulation seal mounting portion, a stopper mount provided in the central mount, and a stopper provided in the central mount to secure the insulation seal member to the insulation seal mounting portion.

The insulation seal member is secured to the insulation seal mounting portion by the stopper attached to the stopper mount. When the lamp plug is pulled out of the lamp socket, the insulation seal member is not removed from the plugging section together with the lamp plug, thus keep the insulation for a new replacement lamp.

According to still another aspect of the invention, the insulation seal mounting portion extends from the top face of a tubular member in the central mount to the bottom face of the plugging section via a circumferential surface of the tubular member, the insulation seal member comprises a tubular seal body with a head portion and an abutment step between the inner surfaces of the head portion and the seal body, the stopper comprises a seal press for pressing the head portion of the insulation seal member, with the insulation seal member being attached to the mounting portion such that the abutment step is abutted against the end face of the tubular member to hold the head portion between the seal press of the stopper and the end face of the tubular member.

By holding the head portion of the insulation seal member between the seal press of the stopper and the end face of the tubular member, the insulation seal member is secured to the insulation seal mounting portion.

When the lamp plug is pulled out of the lamp socket, the insulation seal member is not removed from the plugging section thus keeping the insulation for a new replacement lamp.

According to yet another aspect of the invention, the stopper mount comprises an engaging portion for engagement with the stopper, the stopper comprises a seal press for pressing the head portion of the insulation seal member, leg portions extending from the seal press, and engaging projections provided on the leg portions for engagement with the engaging portion of the stopper mount.

The leg portions of the stopper are inserted into the stopper mount so that the engaging projections engage the engaging portions of the stopper mount, the seal press presses the insulation seal member to secure the insulation seal member. When the lamp plug is pulled out of the lamp socket, the insulation seal member is not separated from the plugging section, thus keeping the insulation for a replacement lamp.

According to another aspect of the invention, the leg portions of the stopper are united at its tips by a bridge member.

Since the tips of the leg portions are united by the bridge member, the leg portions are not bent inwardly so that the engaging projections are pushed outward, assuring engagement of the engaging projections with the engaging portions.

According to still another aspect of the invention, a pair of guide ribs are provided on the inner surface of the tubular member in the axial direction to form a guide and a support is provided on the stopper to abut on the end of the guide such that the engaging projections engage the engaging portions of the stopper mount.

Since the support the stopper abuts on the end of the guide on the stopper mount, the stopper is not press down so that the seal press does not crush the head portion of the insulation seal member, holding the head portion between the end face of the tubular member and the seal press of the stopper, thus assuring the mount of the insulation seal member on the insulation seal mounting portion.

According to yet another aspect of the invention, the insulation seal member has a tubular seal body, a conic surface on the head portion, and a flange portion provided at the base of the seal body so that when the lamp plug is plugged in the lamp socket, it is held down by the end face of the plugging section.

When the lamp plug is plugged in the lamp socket, the end face of the plugging section presses down the flange portion of the insulation seal member and the conic surface is pressed on the conic surface of the circular recess on the end face of the plugging portion. The transitional area between the seal body and the conic surface is pressed strongly so that the conic surface of the circular recess is brought into close contact with the insulation seal member, forming no creepage surface and keeping the high breakdown voltage.

DESCRIPTION OF THE PREFERRED EMBODIMENT

Figure 1:
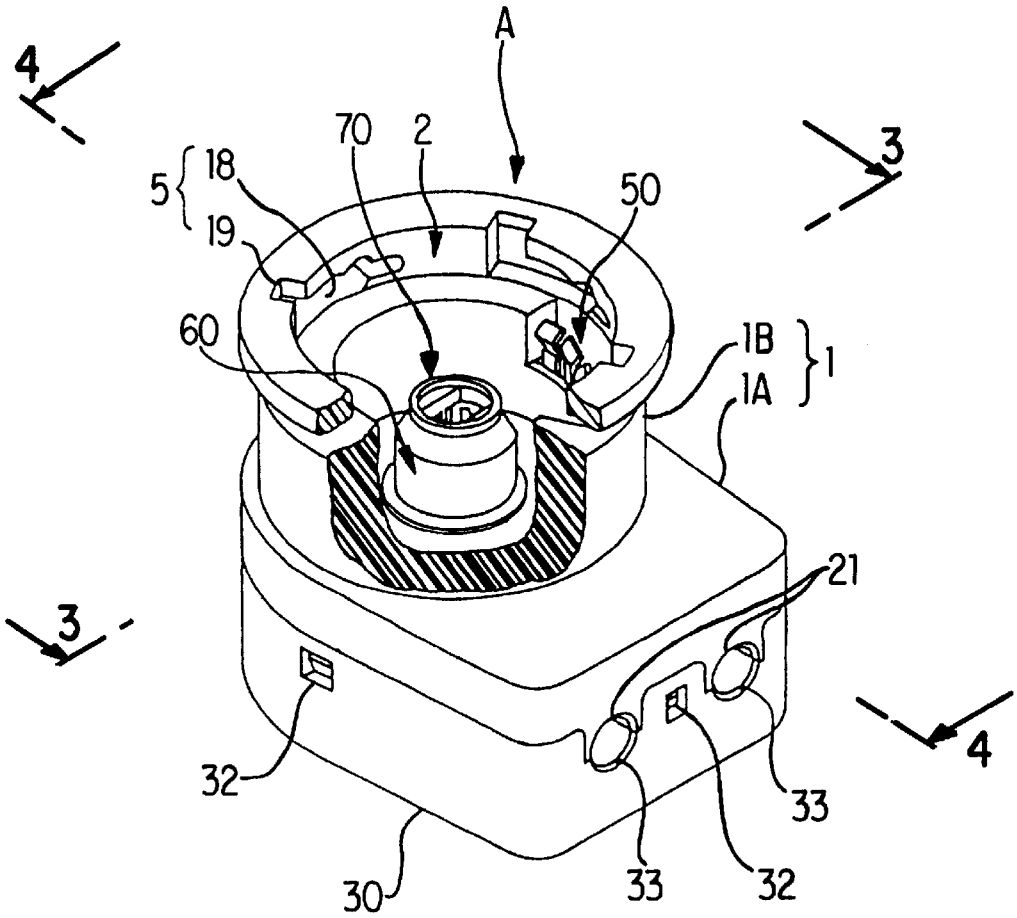
FIG. 1 is a partially cutaway, perspective view of the lamp socket.

The lamp socket A includes a socket body 1, a cover member 30, a central terminal 40 provided at the center of the socket body 1, an outer terminal 50 provided at the periphery of the socket body 1, an insulation seal member 60, and a stopper 70.

As FIGS. 5–10 show, the socket body 1 includes a base section 1A having a square front and a round back and a plugging section 1B having a cylindrical shape. A plugging cavity 2 is provided in the plugging section 1B. A central outlet 3 is provided in the base section 1A. A central mount 9 with a tubular member 6 is provided at the center of the plugging cavity 2, and a plugging space 4 and an engaging portion 5 are provided around the central mount 9.

The plugging space 4 has an annular shape defined by the tubular member 6 and the inner surface 2*a* of a side wall of the plugging cavity 2. An insulation seal mount portion 7 extends downward from the top face of the tubular member 6 to a bottom face 2*b* of the plugging cavity 2. A stopper mount 8 and a mount recess 9A are provided in the central mount 9. An outer mount 10 is provided in the side wall of the plugging space 4.

The stopper mount 8 has a pair of guide grooves 11 provided on the inner surface 6*a* of the tubular member 6. Two pairs of guide ribs 11*a* are provided along the axis of the tubular member 6 to form the guide grooves 11. The lower ends of the guide ribs 11*a* are joined together to form engaging portions 12.

A pair of flat walls 9*a* are provided in the mount recess 9A which has a substantially square shape. A pair of projections 13 is provided on a side wall which extends in a direction perpendicular to the flat walls 9*a*, forming engaging portions 14 between the projections 13 and the flat walls 9*a*. A terminal aperture 15 is provided near one of the flat walls 9*a* to communicate the mount recess 9A to the terminal outlet 3.

The outer mount 10 is separated from the plugging space 4 by the partition wall 16 above which a terminal window 16A is provided. A terminal aperture 17 communicates the outer mount 10 to the terminal outlet 3.

The lamp engaging portions 5 consist of a plurality of engaging channels 18 provided in the side wall of the plugging cavity 2 at predetermined intervals in the circumferential direction and a plurality of insertion grooves 19 connected to ends of the engaging channels 18. A plurality of engaging projections 20 are provided on the side wall of the base section 1A, and a pair of cable outlets 21 are provided in an end face of the base section 1A.

Figure 2:
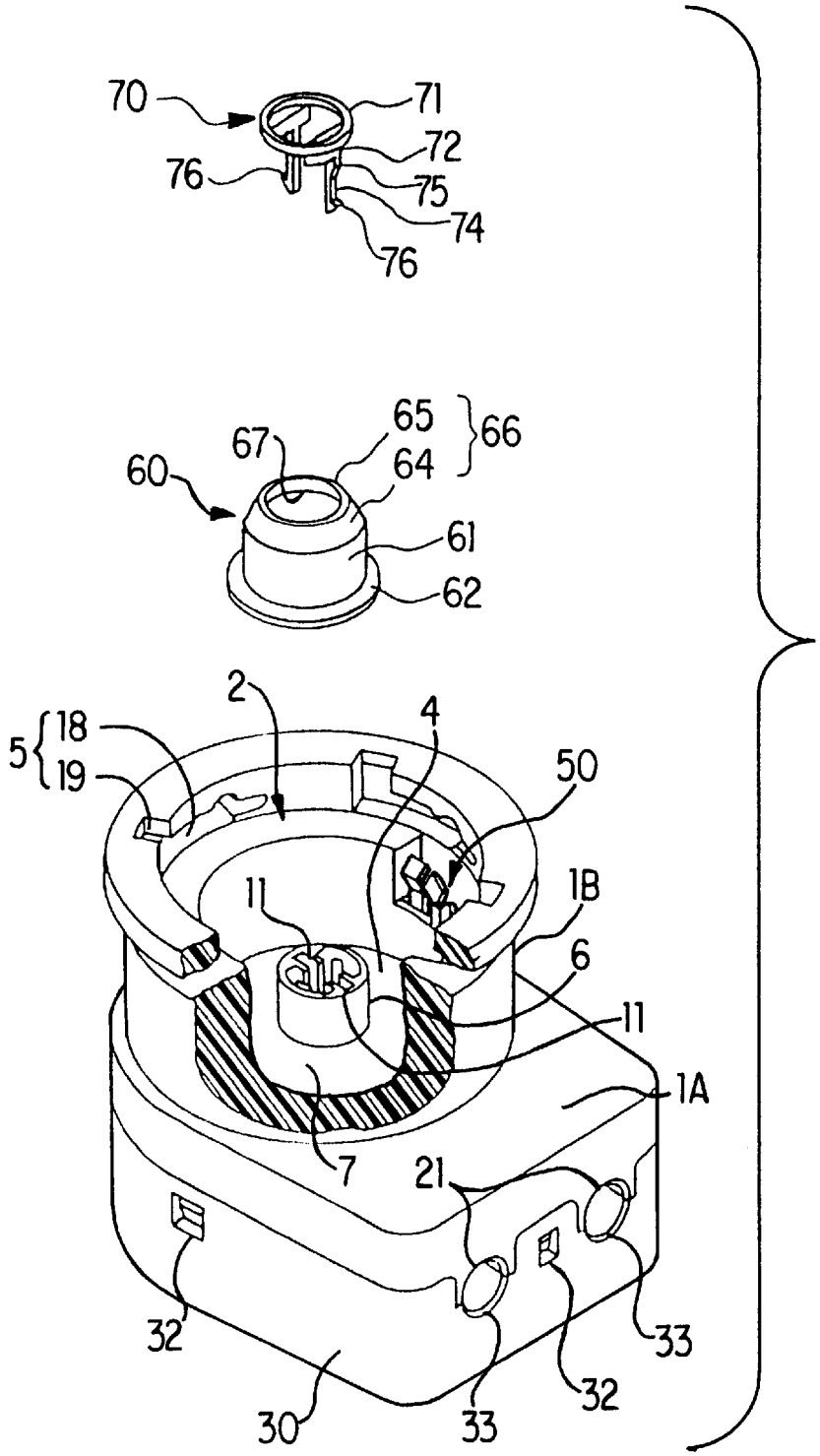
FIG. 2 is an exploded, partially cutaway, perspective view of the lamp socket.
Figure 3:
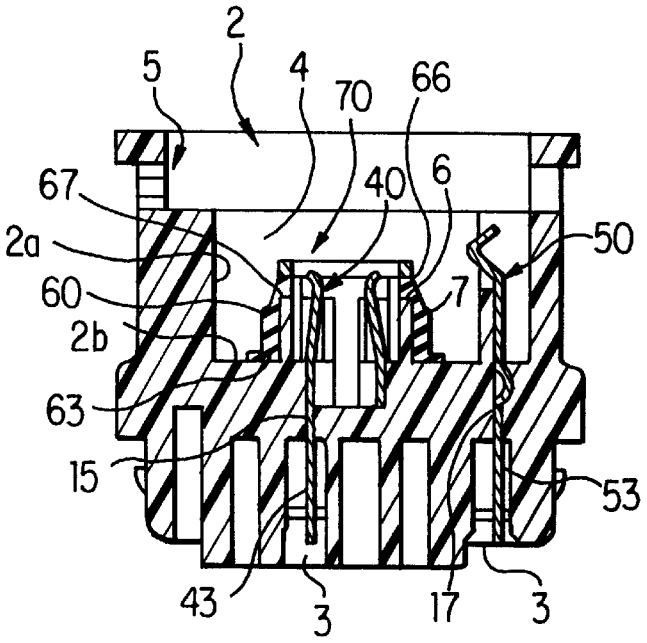
FIG. 3 is a sectional view taken along line 3—3 of FIG. 1.

As FIGS. 1 and 2 show, the cover member 30 is attached to the base section 1A and has a side wall 31 in which a plurality of engaging apertures 32 are provided, and an end wall in which a pair of cable outlets 33 are provided.

Figure 11:
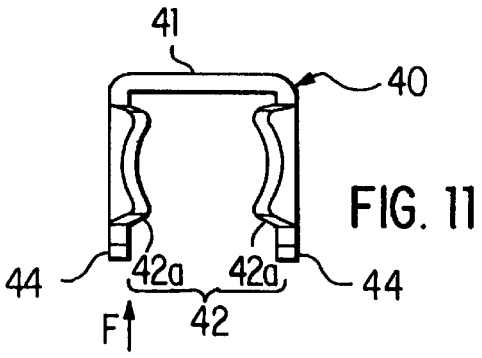
FIG. 11 is a plan view of a central terminal.
Figure 12:
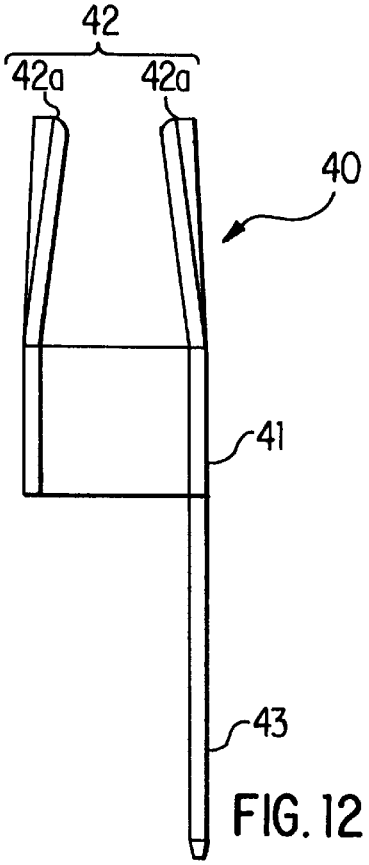
FIG. 12 is a side view as viewed from an arrow F of FIG. 11.
Figure 13:
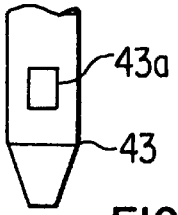
FIG. 13 is a front view of part of a leg portion of the central terminal.
Figure 14:
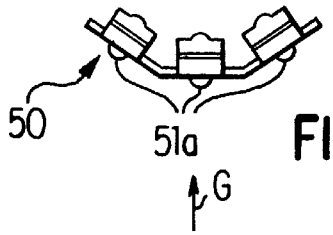
FIG. 14 is a plan view of an outer terminal.
Figure 15:
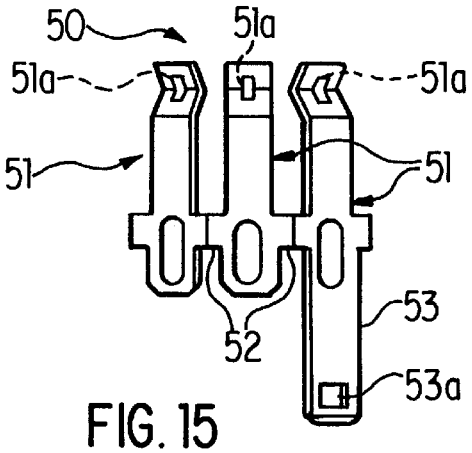
FIG. 15 is a side view as viewed from an arrow G of FIG. 14.
Figure 16:
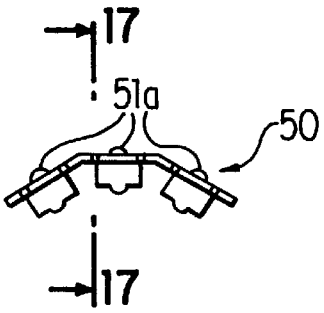
FIG. 16 is a bottom view of the outer terminal.
Figure 17:
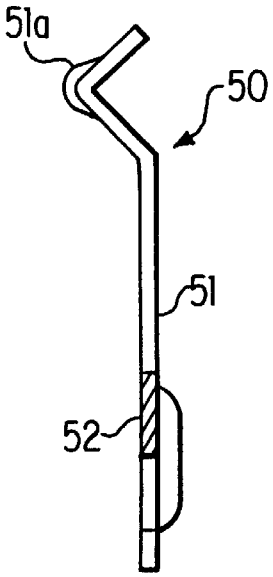
FIG. 17 is a sectional view taken along line 17—17 of FIG. 16.

As FIGS. 11–13 show, the central terminal 40 has a press fitting portion 41 having a C-shaped cross-section, a pair of opposed contact pieces 42*a* extending upward from the press fitting portion 41, and a terminal leg 43 extending downward from the press fitting portion 41. A pair of free ends of the press fitting portion 41 are made as engaging portions 44. An engaging hole 43*a* is provided in the terminal leg 43.

As FIGS. 14–17 show, the outer terminal 50 has a linking section 52, three terminal portions 51 extending upward from the linking section 52 and having contact points 51*a*, and a terminal leg 53 extending downward from the linking section 52. An engaging hole 53*a* is provided in the terminal leg 53.

Figure 18:
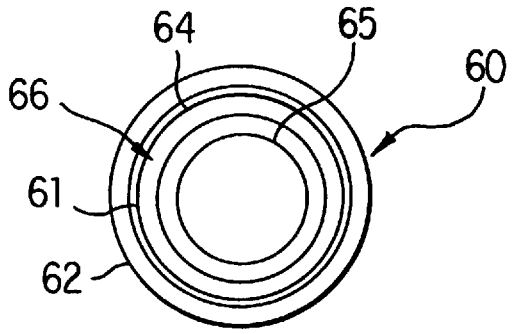
FIG. 18 is a plan view of an insulation seal member.
Figure 19:
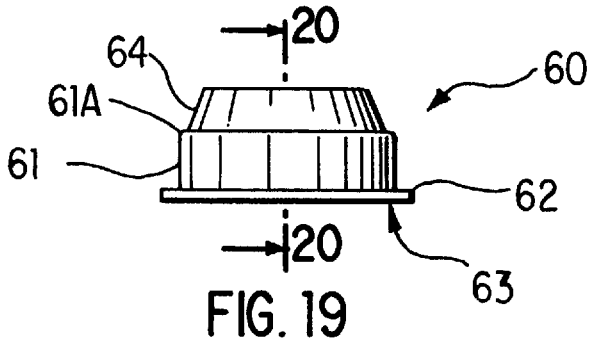
FIG. 19 is a side view of the insulation seal member.
Figure 20:
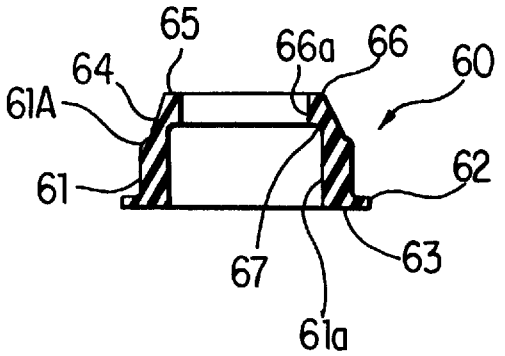
FIG. 20 is a sectional view taken along line 20—20 of FIG. 19.
Figure 21:
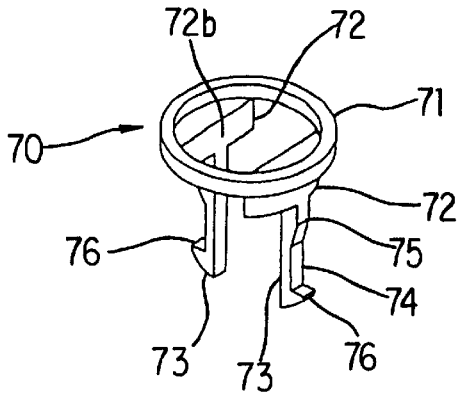
FIG. 21 is a perspective view of a stopper.
Figure 22:
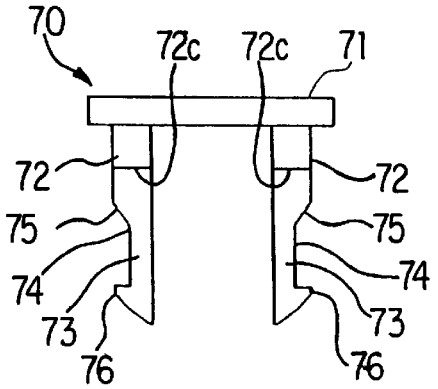
FIG. 22 is a front view of the stopper.
Figure 23:
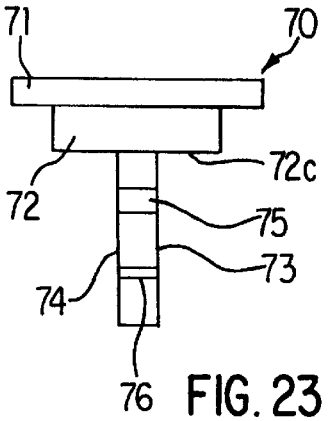
FIG. 23 is a side view of the stopper.
Figure 24:
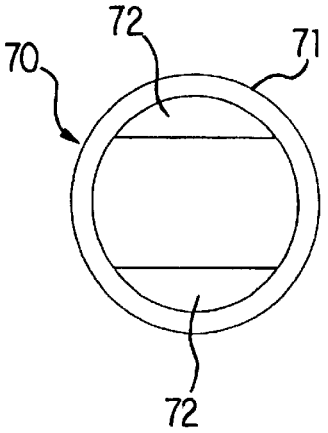
FIG. 24 is a plan view of the stopper.
Figure 25:
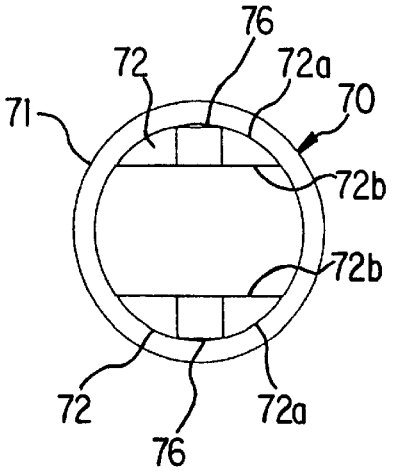
FIG. 25 is a bottom view of the stopper.

As FIGS. 18–20 show, the insulation seal member 60 is made from a resilient material, such as urethane gum, so as to provide a tubular seal body 61. A flange portion 62 is provided at the seat portion 63 of the seal body 61. The seal body 61 has a cone surface 64 and a head portion 66 with a flat end face 65. The inside diameter of the head portion 66 is made smaller than that of the seal body 61, and the difference between the inner surface 66*a* of the head portion 66 and the inner surface 61*a* of the seal baby 61 forms an abutment face 67. A step transition 61A is provided between the tubular seal body 61 and the cone surface 64.

FIGS. 21–25 show, the stopper 70 has an annular seal press 71 and a pair of supports 72 provided below the seal press 71. The supports 72 have an outer arcking surface 72*a* and an inner flat surface 72*b*. A pair of legs 73 extend downward from the middle of the bottom surface 72*c* of the supports 72. A cutout 74 is provided in each leg 73 to provide a guide portion 75 and an engaging projection 76.

The central terminal 40 is attached to the socket body 1 by inserting the press fitting portion 41 into the mount recess 9A of the central mount 9 such that the contact portion 42 of the central terminal 40 is located in the tubular member 6, the terminal leg 43 projects in the terminal outlet 3 via the terminal aperture 15, and the engaging portions 44 engage the engaging portions 14 of the socket body 1.

The outer terminal 50 is press fitted in the outer mount 10 of the socket body 1 such that the contact point 51*a* of the outer terminal 50 projects into the plugging space 4 via the terminal window 16A. The terminal leg 53 of the outer terminal 50 projects into the terminal outlet 3 via the terminal aperture 17.

The insulation seal member 60 is attached to the insulation seal mounting portion 7 of the tubular member 6 such that the seat face 63 and the inner surface 61*a* of the seal body 61 abut on the bottom face 2*b* of the plugging cavity 2 and the outer surface of the tubular member 6, respectively, the abutment face 67 of the head portion 66 of the seal body 61 abuts on the top face of the tubular member 6.

Figure 4:
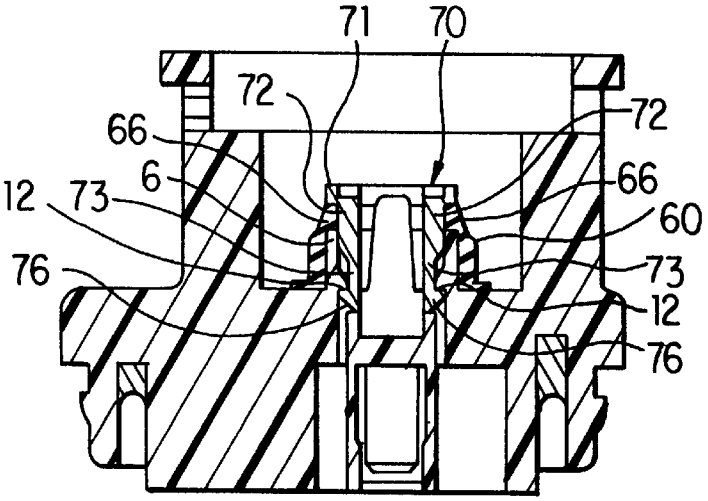
FIG. 4 is a sectional view taken along line 4—4 of FIG. 1.
Figure 5:
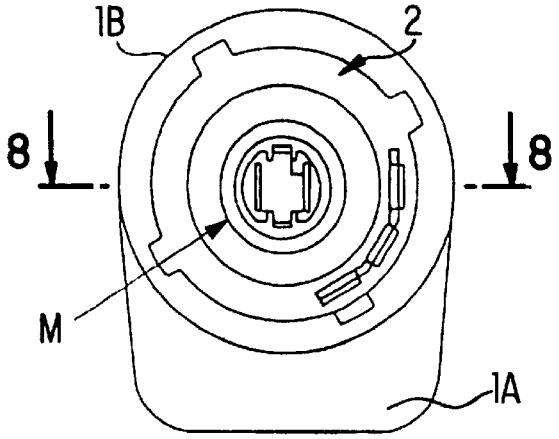
FIG. 5 is a plan view of a socket body for the lamp socket.
Figure 6:
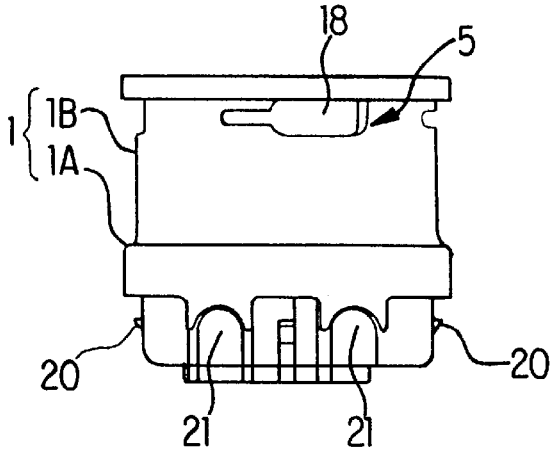
FIG. 6 is a front view of the lamp socket.
Figure 7:
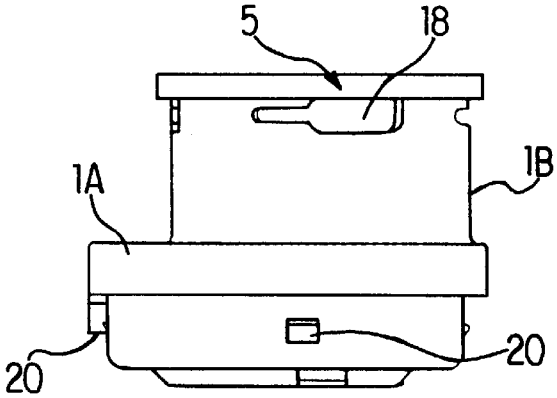
FIG. 7 is a side view of the lamp socket.
Figure 8:
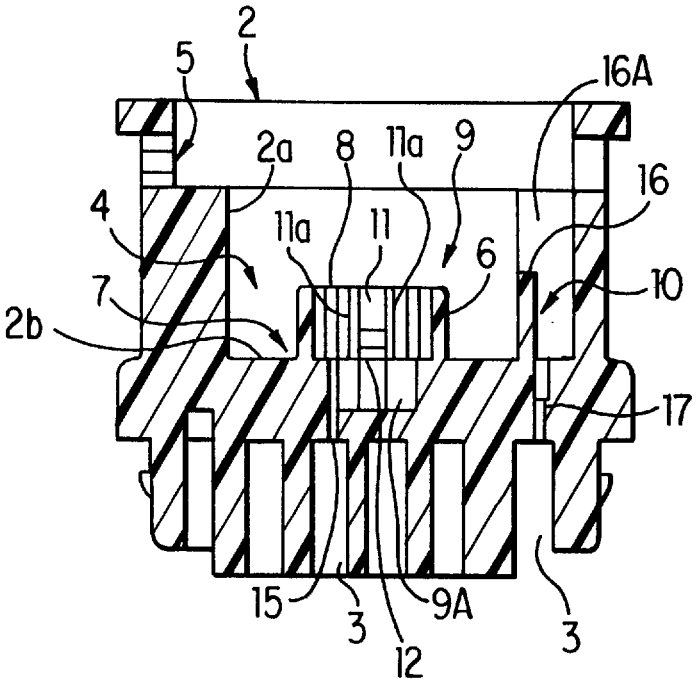
FIG. 8 is a sectional view taken along line 8—8 of FIG. 5.
Figure 9:
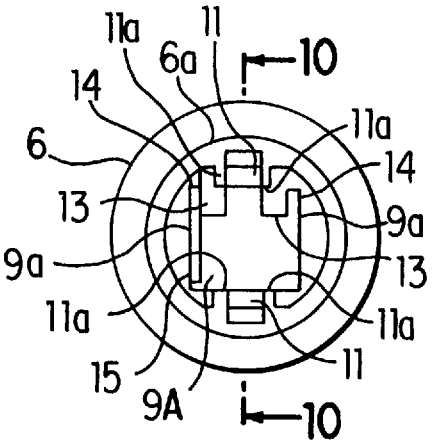
FIG. 9 is an enlarged view of an M portion in FIG. 5.
Figure 10:
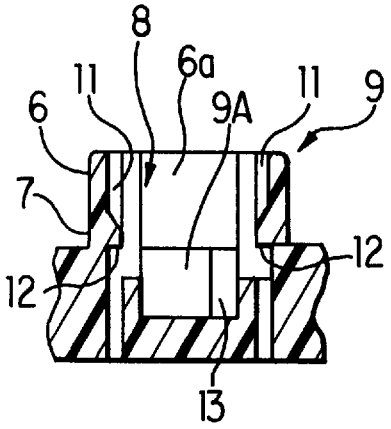
FIG. 10 is a sectional view taken along line 10—10 of FIG. 9.

As FIG. 4 shows, the stopper 70 is attached to the stopper mount 8 of the tubular member 6 to prevent the insulation seal member 60 from coming off from the insulation seal mount 7. That is, the guide portions 75 of the stopper legs 73 are fitted into the guides 11, and the top portions of the guides 11 abut on the lower faces 72*c* of the supports 72 while the engaging projections 76 of the legs 73 engage the engaging portions 12 of the stopper mount 8, and the seal press 71 presses the flat end face 65 of the head portion 66 of the insulation seal member 60. Thus, attachment of the insulation seal member 60 to the insulation seal mounting portion 7 is secured by holding the head portion 66 of the insulation seal member 60 between the end face of the tubular member 6 and the seal press 71 of the stopper 70.

The cover member 30 is attached to the base section 1A of the socket body 1 by engaging the engaging holes 32 with the engaging projections 20 to unite the cable outlets 21 and 33 of the socket body 1 and the cover member 30, allowing the cables (not shown) to go through these cable outlets 21 and 33.

Figure 26:
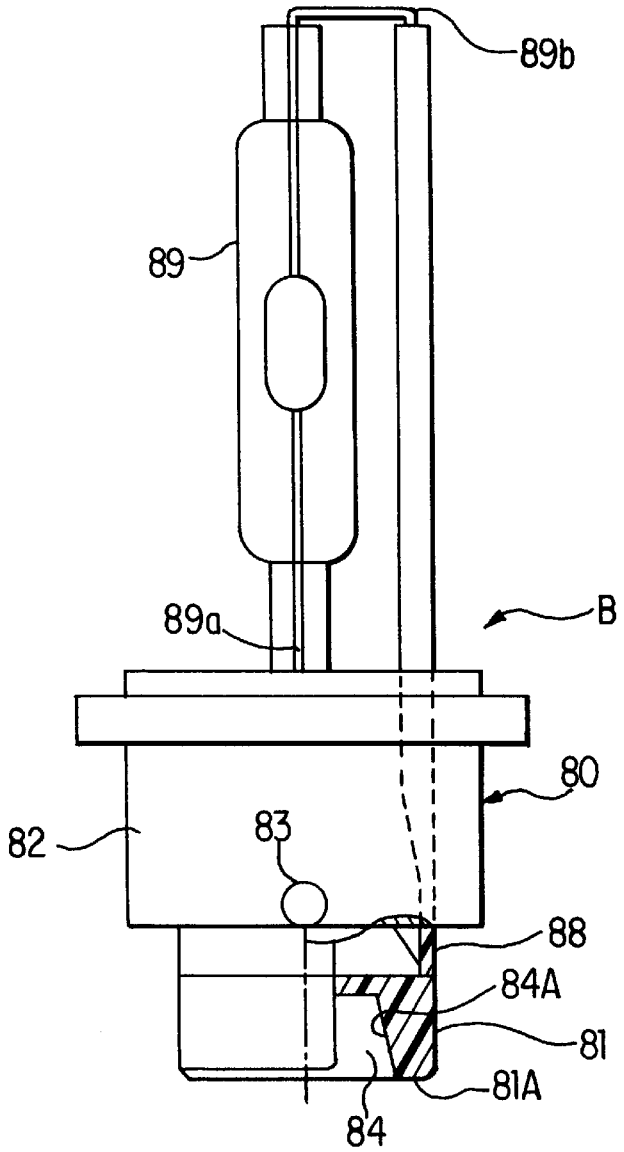
FIG. 26 is a side view of a lamp plug.
Figure 27:
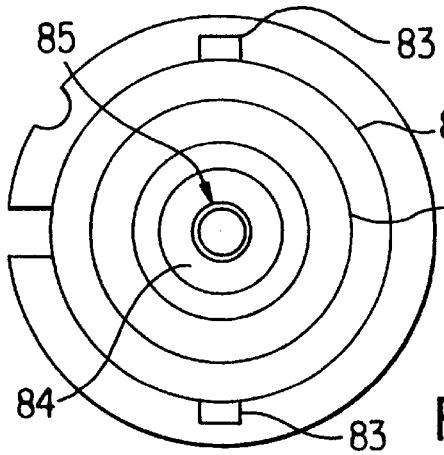
FIG. 27 is a bottom view of the lamp plug.

As FIG. 26 shows, the lamp plug B includes a plug body 80 which has a plugging portion 81 to be plugged into the plugging space 4 of the lamp socket A and an engaging portion 82 to be engaged with the engaging portion 5 of the lamp socket A. An engaging pin 83 is provided on the engaging portion 81. A circular recess 84 is provided in the end face 81A of the plugging portion 81, with a conic surface 84A.

A central terminal 85 is provided at the center of the plug body 80 and projects into the circular recess 84. An annular contact 88 is provided around the plugging portion 81.

A lamp bulb 89 is connected to a lamp connector (not shown) of the central terminal 85 such that contact points 89*a* and 89*b* of the lamp bulb 89 are electrically connected to the central terminal 85 and the annular contact 88, respectively.

The lamp plug B is plugged in the lamp socket A by fitting the plugging portion 81 in the plugging space 4 of the lamp socket A such that the engaging pins 83 are inserted into the insertion grooves 19 and rotating the lamp plug B to engage the engaging pins 83 with the engaging channels 18. Consequently, the central terminal 85 is brought into contact with the contact portion 42*a* of the central terminal 40 while the annular contact 88 of the plugging portion 81 is brought into contact with the contact point 51*a* of the outer terminal 50.

Figure 28:
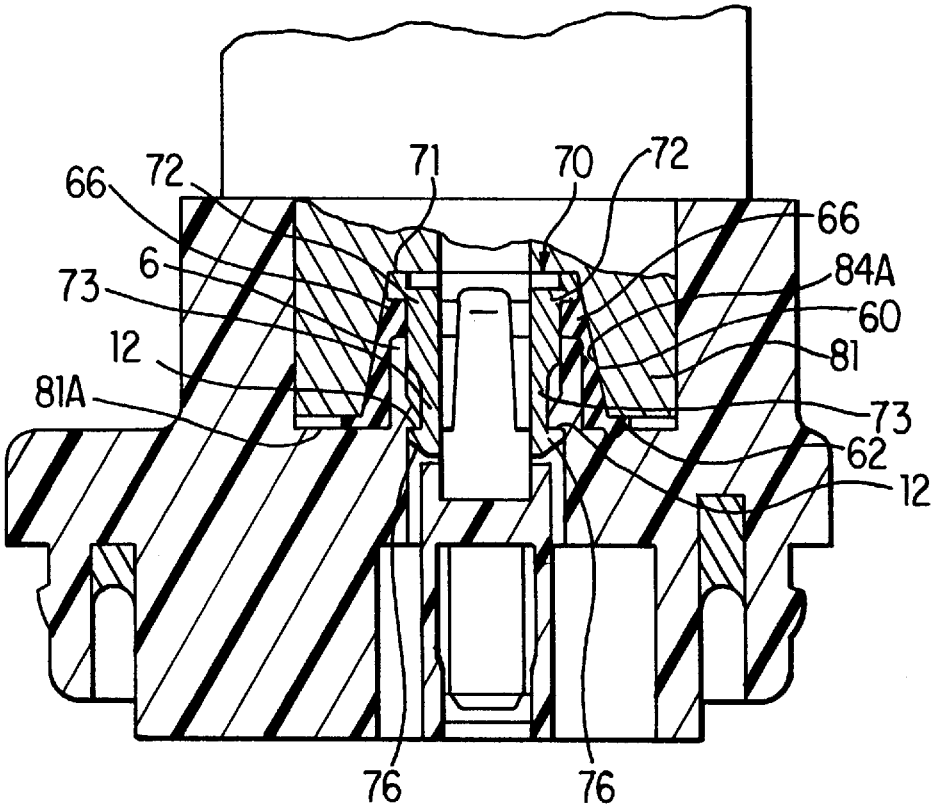
FIG. 28 is a sectional view showing how the insulation seal member undergoes elastic deformation.
Figure 29:
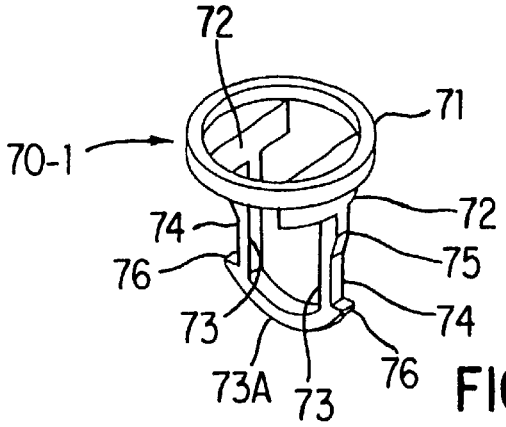
FIG. 29 is a perspective view of a stopper according to a second embodiment of the invention.
Figure 30:
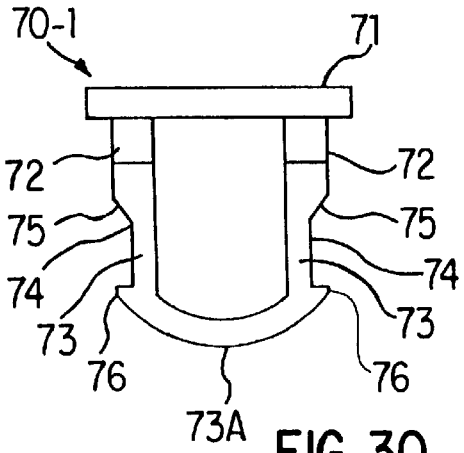
FIG. 30 a front view of the stopper.
Figure 31:
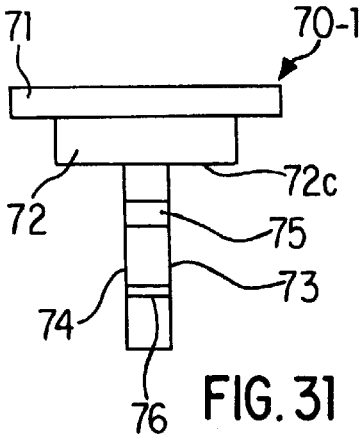
FIG. 31 is a side view of the stopper.
Figure 32:
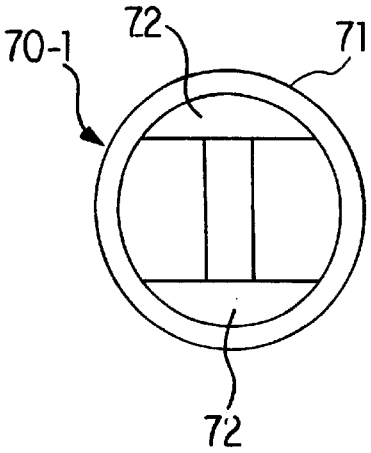
FIG. 32 is a plan view of the stopper.
Figure 33:
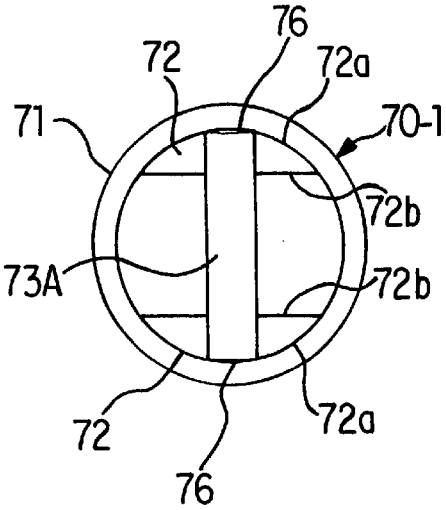
FIG. 33 is a bottom view of the stopper.
Figure 34:
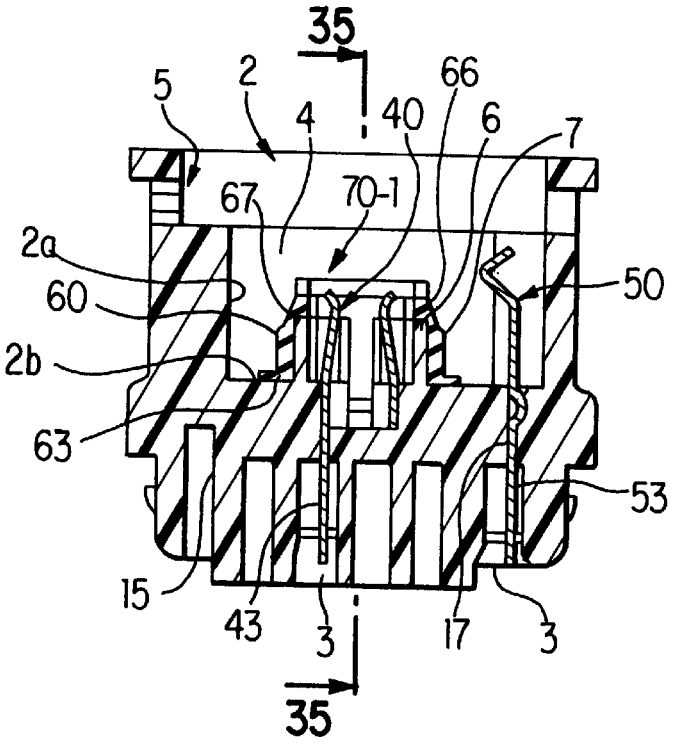
FIG. 34 is a longitudinal section of a lamp socket according to the second embodiment.

As FIG. 28 shows, the end face 81A of the plugging portion 81 presses the flange portion 62 of the insulation seal member 60, and the cone surface 84 of the circular recess 84A abuts against the cone surface 64 of the seal body 61 and the head portion 66 to crush the transitional portion 61A between the seal body 61 and the cone surface 64 so that the cone surface 84A of the circular recess 84 is brought into contact with the insulation seal member 60 without any gap. Accordingly, there is no creepage surface, thus increasing the breakdown voltage.

As has been described above, the seat face 63 and the inner surface 60*a* of the insulation seal member 60, and the end face of the tubular member 6 are abutted against the bottom face of the plugging space 4, the outer surface of the tubular member 6, and the abutment face 67 of the head portion 66, respectively, and the guide portions 75 of the leg portions 73 are inserted in the guides 11 of the stopper mount 8, the lower surface 72*c* of the supports 72 is abutted against the top face of the guides 11. Then, the engaging projections 76 of the leg portions 73 engage the engaging portion of the stopper mount 8, and the seal press 71 presses the flat end face 65 of the head portion 66. In this way, the head portion 66 of the insulation seal member 60 is held between the end face of the tubular member 6 and the seal press 71 of the stopper 70 to assure attachment of the insulation seal member 60 to the mount portion 7.

When the plugging portion 81 of the lamp plug is pulled out of the plugging space 4 of the lamp socket, the insulation seal member 6 is not removed along with the plugging portion 81. Consequently, the insulation is maintained when a new lamp plug B is plugged in the lamp socket A.

When the engaging projections 76 of the leg portions 73 engage the engaging portions 12 of the stopper mount 8, the lower faces 72*c* of the supports 72 are abutted against the end portions of the guides 11 of the stopper mount 8 so that even if the stopper 70 is further pressed, the stopper 70 is not depressed. Consequently, the seal press 71 of the stopper 70 does not crush the head portion 66 of the insulation seal member 60 so that the head portion 66 is secured between the end face of the tubular member 6 and the seal press 71 of the stopper 70, thereby assuring attachment of the insulation seal member 60 to the mount portion 7.

FIGS. 29–35 show the second embodiment of the invention. The stopper of the second embodiment is different from that of the first embodiment. The other parts are the same as those of the first embodiment and have the same reference numerals, and the description is omitted.

As FIGS. 29–33 show, the stopper 70-1 has an annular seal press 71. A pair of supports 72 are provided on the back face of the seal press 71. The supports 72 have an outer arcking face 72*a* and an inner flat face 72*b*. A pair of leg portions 73 extend downward from the lower faces 72*c* of the supports 72. The tips of the leg portions 73 are united by a bridge member 73A. A pair of cutouts 74 are provided in the leg portions 73 to form guide portions 75 and engaging projections 76.

Figure 35:
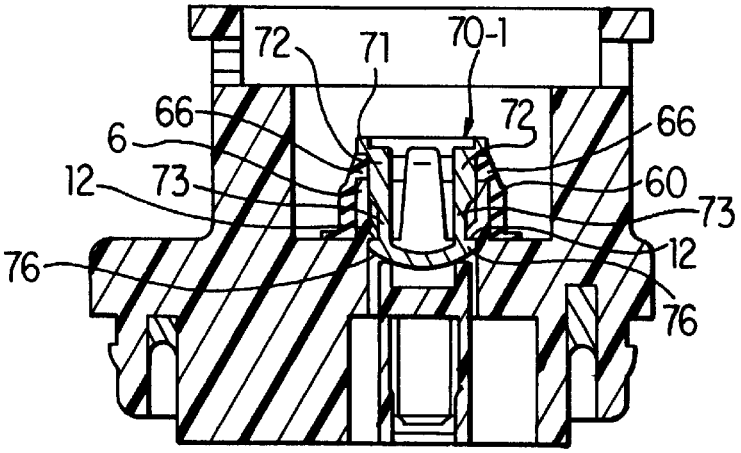
FIG. 35 is a sectional view taken along line 35—35 of FIG. 34.
Figure 36:
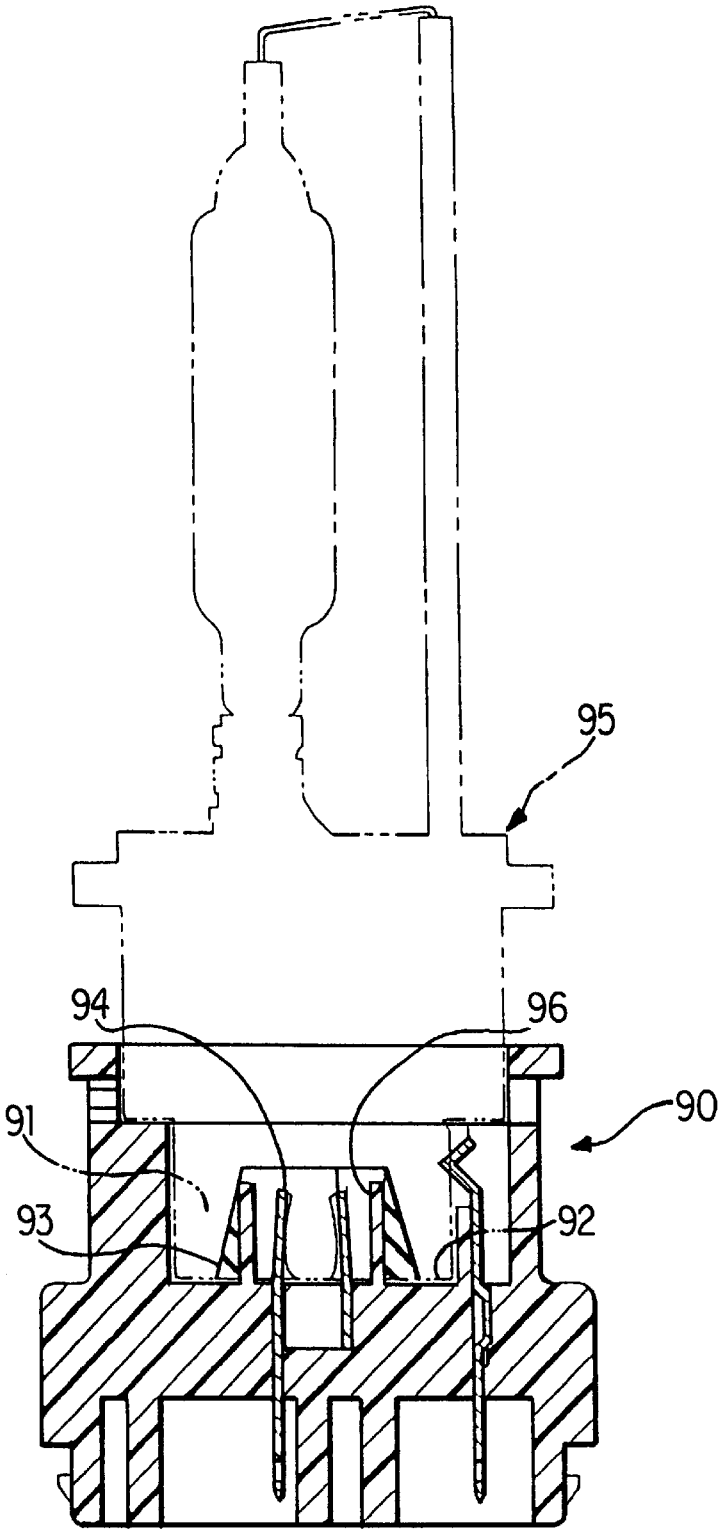
FIG. 36 is a sectional view of a conventional lamp socket.

As FIG. 35 shows, the stopper 79-1 is attached to the stopper mount 8 of the tubular member 6 to prevent the insulation seal member 60 from coming off from the mounting portion 7. The top portions of the guides 11 are abutted against the lower face 72*c* of the supports 72 while the engaging projections 76 of the leg portions 73 engage the engaging portions 12 of the stopper mount 8, and the seal press 71 presses the flat end face 65 of the head portion 66. In this way, the head portion 66 of the insulation seal member 60 is held between the end face of the tubular member 6 and the seal press 71 of the stopper 70-1 to assure attachment of the insulation seal member 60 to the mounting portion 7.

Since the tips of the leg portions 73 are united by the bridge member 73A, the leg portions 73 are not bent inwardly to a large extent and are protected from damage. Since the engaging projection 76 is biased outward, engagement of the engaging projection 76 with the engaging portion 12 is secured.

According to one aspect of the invention, the lamp socket comprises a socket body, a central mount provided at the center of a plugging section, a central terminal provided in the central mount, an outer mount provided in the periphery of the plugging section, an outer terminal provided in the outer mount, an insulation seal mount provided around the central mount, a stopper mount provided in the central mount, an insulation seal member provided in the insulation seal mount, a stopper provided in the stopper mount to secure the insulation seal member to the insulation seal mount so that when the lamp plug is plugged out of the lamp socket, the insulation seal member is not separated from the insulation seal mount, thus always keeping good insulation.

According to another aspect of the invention, the insulation seal mount extends downward from the top face of the tubular member to the bottom face of the plugging cavity via the circumferential surface of the tubular member, and the insulation seal member comprises a seal body having a head portion and an abutment step between the inner surface of the head portion and the inner surface of the seal body, the stopper is provided with a seal press for pressing down the head portion of the insulation seal member. The insulation seal member is attached to the insulation seal mount such that the end face of the tubular member is abutted against the abutment step of the head portion, and the head portion of the insulation seal member is held between the seal press of the stopper and the end face of the tubular member such that the end face of the tubular member is abutted against the abutment face of the head portion, the head portion of the insulation seal member is pressed by the seal press of the stopper to secure the insulation seal member to the insulation seal mount.

Consequently, when the lamp plug is plugged out of the lamp socket, the insulation seal member is not removed from the plugging cavity, thus always keeping good insulation.

According to still another aspect of the invention, the stopper mount has an engaging portion for engagement with the stopper, the stopper has a seal press for pressing the head portion of the insulation seal member and a pair of leg portions having engaging projections for engagement with the engaging portions of the stopper mount such that the leg portions are fitted into the stopper mount so that the engaging projections engage the engaging portion of the stopper mount while the seal press presses down the insulation seal member for securing the insulation seal member. When the lamp plug is pulled out of the lamp socket, the insulation seal member is not separated from the plugging section, thus keeping the insulation for a replacement lamp.

According to yet another aspect of the invention, the leg portions of the stopper are united at its tips by a bridge member. Since the tips of the leg portions are united by the bridge member, the leg portions are not bent inwardly so that the engaging projections are pushed outward, assuring engagement of the engaging projections with the engaging portions.

According to another aspect of the invention, a pair of guide ribs are provided on the inner surface of the tubular member in the axial direction to form a guide and a support is provided on the stopper to abut on the end of the guide such that the engaging projections engage the engaging portions of the stopper mount. Since the support the stopper abuts on the end of the guide on the stopper mount, the stopper is not press down so that the seal press does not crush the head portion of the insulation seal member, holding the head portion between the end face of the tubular member and the seal press of the stopper, thus assuring the mount of the insulation seal member on the insulation seal mounting portion.

According to still another aspect of the invention, the insulation seal member has a tubular seal body, a conic surface on the head portion, and a flange portion provided at the base of the seal body so that when the lamp plug is plugged in the lamp socket, it is held down by the end face of the plugging section. When the lamp plug is plugged in the lamp socket, the end face of the plugging section presses down the flange portion of the insulation seal member and the conic surface is pressed on the conic surface of the circular recess on the end face of the plugging portion.

The transitional area between the seal body and the conic surface is pressed strongly but it is not crushed because it is able to escape along the conic surface, thus keeping the high breakdown voltage. Even if the lamp plug is plugged in and out of the lamp socket repeatedly, the insulation seal member keeps its resilience. When the lamp plug is plugged in the lamp socket such that there is a relatively large gap between the conic inner surface of the plugging portion for the lamp plug and the conic outer surface of the tubular member, at least the transitional area and the flange portion of the insulation seal member are pressed so completely that there is provided no gap, thus keeping the high breakdown voltage.

What is claimed is:

1. A lamp socket comprising:

a socket body having a plugging cavity;

a central mount provided at a center of said plugging cavity;

a central terminal provided in said central mount;

an outer mount provided in a periphery of said plugging cavity;

an outer terminal provided in said outer mount;

a mounting portion provided around said central mount;

an insulation seal member provided in said mounting portion; and a stopper provided in said central mount to secure said insulation seal member to said mounting portion.

2. A lamp socket comprising:

a socket body having a plugging cavity;

a central mount provided at a center of said plugging cavity;

a central terminal provided in said central mount;

an outer mount provided in a periphery of said plugging cavity;

an outer terminal provided in said outer mount;

a mounting portion provided around said central mount;

an insulation seal member provided in said mounting portion;

a stopper mount provided in said central mount;

a stopper provided in said stopper mount to secure said insulation seal member to said mounting portion.

3. A lamp socket according to claim 2, wherein said mounting portion comprises a tubular member provided on said central mount and extends from a top face of said tubular member to a bottom face of said plugging cavity; said insulation seal member comprises a tubular seal body having a head portion and an abutment step between an inner face of said head portion and an inner face of said seal body; said stopper comprises a seal press for pressing said head portion of said insulation seal member, said insulation seal member being attached to said mounting portion such that an end face of said tubular member is abutted against said abutment face of said head portion to hold said head of said insulation seal member between said seal press of said stopper and an end face of said tubular member.

4. A lamp socket according to claim 2 or 3, wherein said stopper mount comprises an engaging portion for engaging said stopper, said stopper comprises a seal press for pressing said head portion of said insulation seal member and leg portions extending from said seal press, and said leg portions have engaging projections for engagement with said engaging portion of said stopper mount.

5. A lamp socket according to claim 4, wherein said leg portions are united at their tips by a bridge member.

6. A lamp socket according to claim 4, which further comprises:

a pair of guide ribs provided on an inner face of said tubular member and extending along an axis of said tubular member to form a guide; and a support portion provided on said stopper and abutted against an end portion of said guide such that said engaging projections engage said engaging portions of said stopper mount.

7. A lamp socket according to claim 3, 5, or 6 wherein said seal body has a tubular form, said head portion has a cone surface continuing to said seal body, and a flange portion is provided on a base section of said seal body which is pressed by an end face of said plugging portion when said lamp plug is plugged in said lamp socket.

* * * * *